US006156159A

United States Patent [19]

Ekholm et al.

[11] Patent Number: 6,156,159

[45] Date of Patent: Dec. 5, 2000

[54] DEVICE FOR MIXING OF A FLUID INTO A PULP-SUSPENSION

[75] Inventors: Rolf Ekholm; Ulf Jansson, both of Karlstad, Sweden; Per Nyström, Charlotte, N.C.

[73] Assignee: Kvaerner Pulping AB, Sweden

[21] Appl. No.: 09/407,277

[22] Filed: Sep. 29, 1999

Related U.S. Application Data

[62] Continuation of application No. 08/780,899, Jan. 9, 1997, which is a division of application No. 08/619,605, filed as application No. PCT/SE94/00923, Oct. 4, 1994, Pat. No. 5,711,852.

[30] Foreign Application Priority Data

Oct. 13, 1993 [SE] Sweden ..... 9303353

[51] Int. Cl.[7] ..... D01G 13/00

[52] U.S. Cl. ..... 162/236; 162/234; 162/243; 162/261; 211/46.11; 211/46.17; 261/85; 261/87; 261/DIG. 42; 366/307

[58] Field of Search ..... 241/28, 46.11, 241/46.17; 366/279, 307, 325.1, 329; 261/83, 87, 85, DIG. 42; 162/57, 65, 235, 234, 236, 243, 261, 23, 63, 248

[56] References Cited

U.S. PATENT DOCUMENTS

| | | | |
|---|---|---|---|
| 881,888 | 3/1908 | Atwood . | |
| 3,388,037 | 6/1968 | Asplund et al. . | |
| 3,404,065 | 10/1968 | Ingemarsson | 162/234 |
| 3,411,721 | 11/1968 | Delcellier | 162/236 |
| 3,725,193 | 4/1973 | Montigny et al. . | |
| 4,339,206 | 7/1982 | Ahs . | |
| 4,577,974 | 3/1986 | Prough et al. . | |
| 4,842,690 | 6/1989 | Gazdik et al. . | |
| 5,405,497 | 4/1995 | Torregrossa . | |
| 5,536,368 | 7/1996 | Makela et al. . | |
| 5,863,120 | 1/1999 | Gallagher et al. . | |

FOREIGN PATENT DOCUMENTS

| | | |
|---|---|---|
| 1283902 | 5/1991 | Canada . |
| 174 660 | 3/1961 | Sweden . |
| 419 603 | 8/1981 | Sweden . |
| 1139781 | 2/1985 | U.S.S.R. . |
| WO 92/16288 | 10/1992 | WIPO . |

*Primary Examiner*—John Hoffmann
*Attorney, Agent, or Firm*—Fasth Law Offices; Rolf Fasth

[57] ABSTRACT

Process and device for mixing fluid into a pulp suspension of cellulose-containing fiber material, in which the pulp suspension is pumped in through a pump inlet (17), brought into rotation and, at the desired reaction pressure, mixed with the said fluid while passing through a reaction sector comprising a stator shell (1), a rotor (7) which is coaxial therewith, and at least one fluid inlet (23), after which the pulp mixture leaves the reaction sector through a pulp outlet (20), in which the fluid, via the said fluid inlet (23), is supplied in the vicinity of the center of rotation of the rotating pulp suspension, where the local pressure in the pulp suspension is lower, due to the centrifugal force increasing radially outwards, than the reaction pressure prevailing at the periphery of the pulp suspension.

2 Claims, 5 Drawing Sheets

DEVICE FOR MIXING OF A FLUID INTO A PULP-SUSPENSION

This is a continuation of prior application Ser. No. 08/780,899, filed Jan. 9, 1997, which is a divisional of prior application Ser. No. 08/619,605, filed Apr. 1, 1996 and now U.S. Pat. No. 5,711,852, which is a 371 of PCT application No. PCT/SE94/00923, filed Oct. 4, 1994.

The present invention relates to a process and a device for mixing fluid into a pulp suspension of cellulose-containing fibre material, such as, for example, so-called MC pulp having a dry matter content of 5–25%. The fluid can, for example, consist of ozone-containing gas, the admixture taking place with the aim of bleaching the pulp suspension with one or more bleaching agents which include ozone, supplied together with a carrier gas.

TECHNICAL BACKGROUND AND PROBLEMS

The mixing of, for example, ozone-containing gas into a pulp suspension, during ozone bleaching, usually takes place at a relatively high pressure since the prospects for the bleaching reaction are appreciably improved as the pressure in the reaction sector increases. Therefore, in order to be able to carry out ozone bleaching effectively, both the pulp suspension and the ozone-containing gas must be pressurized.

The apparatus required for pressurizing ozone constitutes by far the largest part of the investment costs associated with ozone delignification of pulp suspensions. The costs of such apparatus increases progressively in relation to increasing pressurization. When generating the gas, large quantities of energy are supplied to the carrier gas, for example pure oxygen, in ozone generators, in association with which a relatively small quantity of ozone is nevertheless formed since the carrier gas can only contain limited quantities of ozone. The total gas flow, which, as a consequence, is very large, is then compressed in so-called liquid ring compressors which are expensive and susceptible to disturbances.

In this context, the problem with currently known devices for bleaching pulp suspensions with ozone is that the reaction pressure which is possible is limited by the capacity of the compressors. In an example taken from a currently existing device, the compressors operate at an excess pressure of 10 bar. The pressure in the mixer may then, in practice, not exceed 7–8 bar excess pressure if blockage of the compressors at the slightest disturbance is to be avoided.

Nowadays, the admixture usually takes place by the pulp suspension being brought into rotation using a rotor surrounded by a coaxial stator, with the gas being supplied in the periphery of the rotating pulp suspension where the counter pressure for the compressors is greatest.

OBJECT OF THE INVENTION

The object of the present invention is to remove the abovementioned problems by developing a process and a device which make it possible to add the fluid, for example in the form of ozone-containing gas, at a lower pressure than the reaction pressure of the device.

TECHNICAL SOLUTION

The abovementioned object is achieved by the invention making available a process and a device for mixing ozone-containing gas into a pulp suspension of a cellulose-containing fibre material in accordance with subsequent patent claims 1 and 11.

The solution proposed by the invention thus implies, in brief, that the fluid is supplied in the vicinity of the centre of the rotating pulp suspension where, owing to the fact that the centrifugal force increases radially outwards, the local pressure in the pulp suspension is lower than the reaction pressure prevailing at the periphery of the pulp suspension.

The solution makes it possible to increase the reaction pressure, which was previously limited by the compressors, while retaining the same compressor. Alternatively, a smaller, appreciably cheaper compressor can be used while maintaining the same reaction pressure in the device.

The invention therefore offers major advantages as compared with previously known technology.

BRIEF DESCRIPTION OF THE DRAWINGS

In that which follows, the invention will be described in more detail with reference to the accompanying drawings in which.

DESCRIPTION OF PREFERRED EMBODIMENTS OF THE INVENTION

Figure 1:
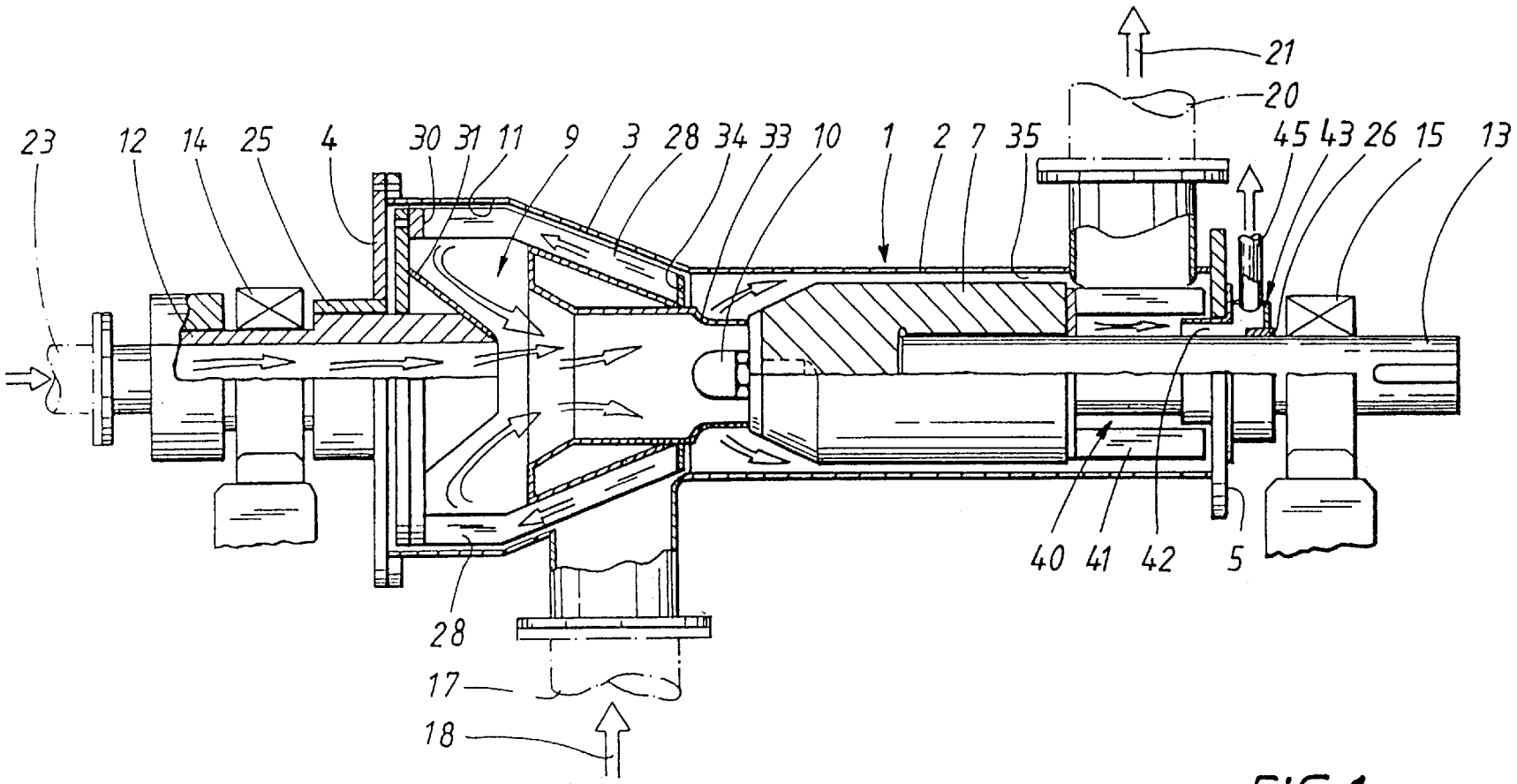
FIG. 1 shows a longitudinal section view of a first embodiment of the invention.

FIG. 1 shows a first embodiment of the invention in which the device is essentially enclosed in a stator shell 1 divided into a cylindrical section 2 and a conical section 3. The stator shell 1 also has two end gables 4 and 5, respectively. A rotor 7 is located inside the stator shell 1, which rotor is coaxial with the stator shell 1. At its one end, a turbulence chamber 9 is fixed to the rotor 7 by means of a nut 10, and, at its other end, fixed to a collar bearing shaft 12. The turbulence chamber 9 and the said collar bearing shaft 12 are both coaxial with the rotor 7. The rotor 7 is, in turn, fixed to a shaft 13 which passes out centrally and is connected to a drive unit, for example in the form of an electrical motor, which is not shown. In this context, the turbulence chamber 9, the rotor 7 and the two shafts 12 and 13 constitute the rotating part of the device, which part is mounted in the bearing housings 14 and 15, respectively. A pulp inlet 17 is connected tangentially to the conical section 3 of the stator shell 1 so that the pulp suspension is fed in in the direction of the arrow 18. In a corresponding manner, a pulp outlet 20 is tangentially connected to the cylindrical section 2 of the stator shell 1 so that the finished pulp mixture is fed out in the direction of the arrow 21. The collar bearing shaft 12 is hollow and contains a central fluid inlet 23 which opens out at the centre of the turbulence chamber 9. The stator shell 1 is sealed against the shafts 12 and 15 by means of stuffing boxes 25, 26 at the end gables 4 and 5, respectively.

The outer side of the turbulence chamber 9 is additionally provided with projecting, slightly twisted wings 28 for fluidizing the pulp suspension which is fed in through the pulp inlet 17. The pulp suspension is thus fed in via the pulp inlet 17 in the conical section 3 of the stator shell 1 and accelerated up to the fluidized state by means of the wings 28 on the outer side of the turbulence chamber 9 while it is being fed out towards the largest diameter 11 of the conical section 3, at which diameter it is caused to deflect against a gable surface 30 and turn into the turbulence chamber 9 where a vortex is formed as the pulp passes a conical surface 31 in the turbulence chamber 9. At the same time, the fluid is supplied axially at the centre of the vortex through the fluid inlet 23.

However, in an alternative embodiment, which is not shown, the fluid can also be supplied radially at the centre of the vortex through radial channels at the end of the fluid inlet.

Figure 3:
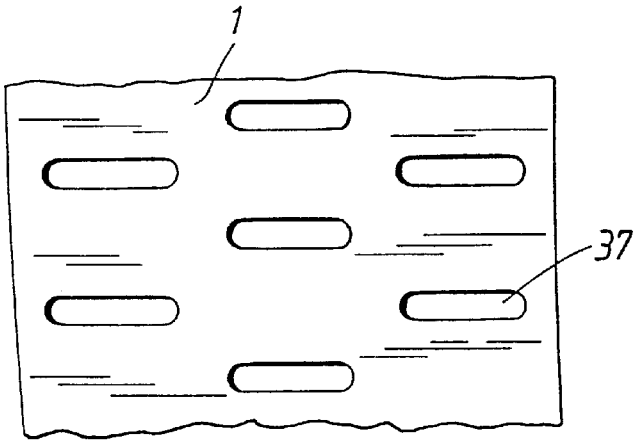
FIGS. 3 and 4 show examples of flow-affecting elements on the inside of the stator shell.
Figure 4:
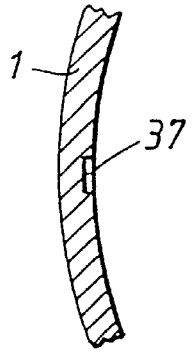

The vortex and the fluid next move within the turbulence chamber 9 to the right of the figure and flow out of the turbulence chamber 9 through radial openings 33 in the periphery of the turbulence chamber. The openings 33 are located in the vicinity of the point where the turbulence chamber 9 is firmly fixed to the rotor 7, and the fluid/pulp mixture now penetrates into the cylindrical section 2 of the stator shell 1, which section is separated from the conical section 3 by means of a gable 34 on the turbulence chamber 9. An intensive mixing next takes place in the annular gap-shaped channel 35 which is defined between the rotor 7 and the cylindrical section 2 of the stator shell 1. With the aim of amplifying the turbulence effect and breaking down the flocculation in the fluid/pulp mixture which is flowing through, the stator shell 1, or, alternatively, the rotor 7, is provided with flow-affecting elements, which, owing to their small size, are not evident in FIG. 1 but which are shown magnified in FIGS. 3 and 4, in the form of slots 37 in the inner side of the stator shell 1. The dimensions of the slots are 30×5×1 mm (length×width×depth). Alternatively, the slots 37 can be replaced by projecting bars whose dimensions are preferably about 30×5×5 mm (length×width×height).

In connection with the pulp outlet 20, a gas separator 40 is located for separating off and conveying away, in this example, unconsumed ozone and inert carrier gas from the outgoing pulp stream. The gas separator 40 comprises radial degassing/fluidizing blades 41 fixed into the rotor 7 in connection with the tangential pulp outlet 20. Using the degassing/fluidizing blade 41, the outgoing pulp is forced, with the aid of the centrifugal force, out through the pulp outlet 20, and the remaining gases, i.e. unconsumed ozone and inert carrier gas, are conducted out through an evacuation channel 42 which runs along the shaft 13 of the rotor 7 and opens out in a degassing box 43 located in the vicinity of the end gable 5 of the stator shell 1. The degassing box 43 is provided with an outgoing tangential conduit 45 for recirculating the said gases in the process.

By supplying the fluid, in the manner described, at the centre of rotation of the vortex, or, more generally, at that of the rotating pulp suspension, the fact is exploited that the local static pressure in the pulp suspension is lower, owing to the centrifugal force increasing radially outwards, in the vicinity of the centre of rotation than it is at the periphery of the pulp suspension. The reaction pressure of the device, i.e. the maximum pressure at which the most efficaceous admixture possible is obtained in the device, prevails in the annular gap-shaped channel 35, where the most intensive admixture takes place in accordance with the above. In this context, the annular gap-shaped channel 35 can be considered to lie in the periphery of the rotating pulp suspension in relation to its centre of rotation. The underlying concept of the invention is thus to render possible supply of fluid, like, in this case, ozone-containing gas, at a pressure which is lower than the reaction pressure of the device.

Figure 2:
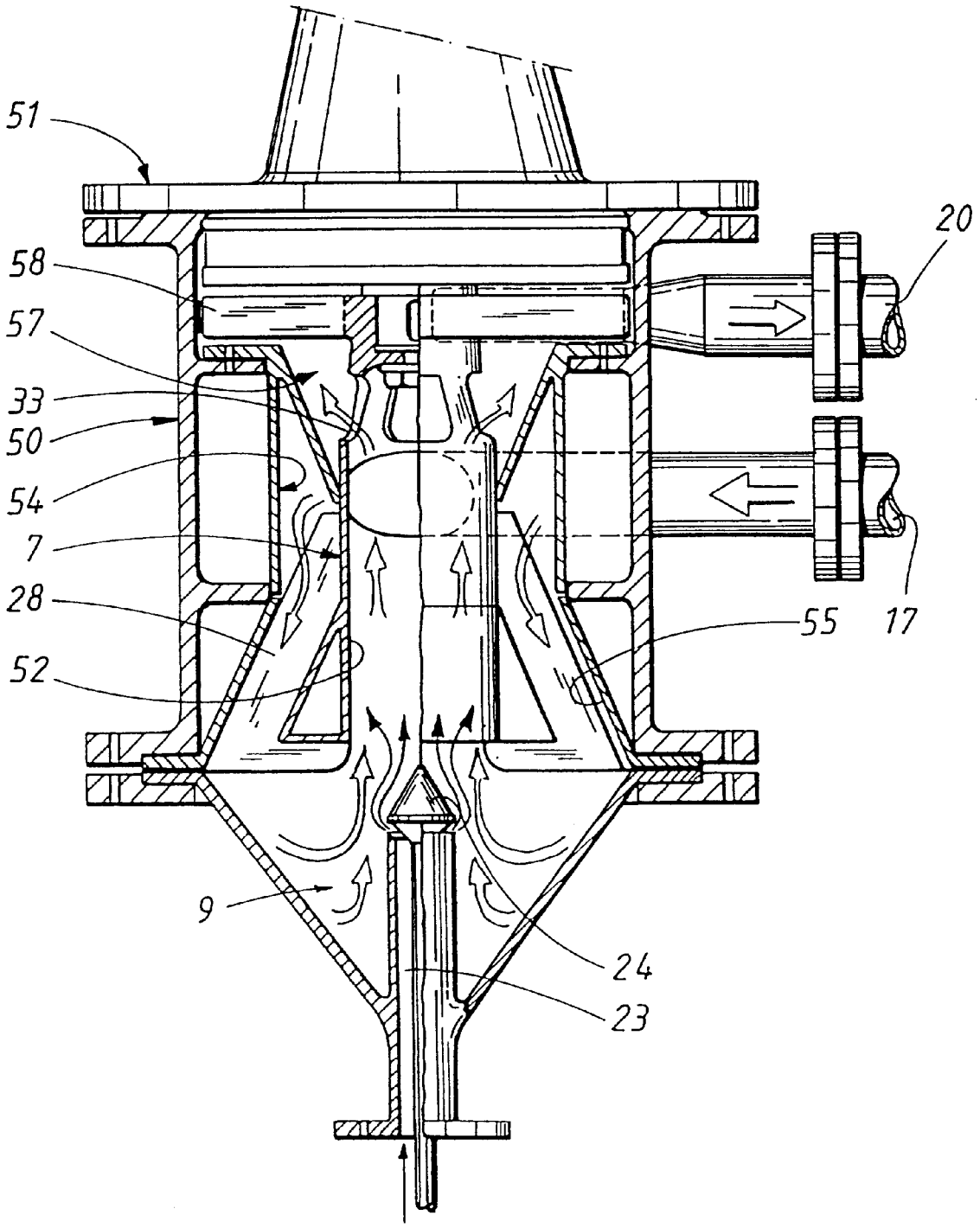
FIG. 2 shows a section view of a second embodiment of the invention.

A second embodiment of the invention is illustrated in FIG. 2. This embodiment has a large number of parts whose function accords in principle with that of the first embodiment in FIG. 1, for which reason such parts are here designated with the same reference numbers as have already been used in connection with the description of the first embodiment. In this case, the device is in the main enclosed by a cylindrical stator shell 1 in whose gable section 51 a rotor 7 is mounted via a shaft which is not shown. The rotor 7 is driven by an external drive unit, for example an electrical motor, which is not shown, and is constructed from a cylindrical hollow shaft 52 and four wings or rotor blades 28 which are fixed into the outer side of the hollow shaft 52. The remaining parts of the device will be introduced below in association with the following description of the function of the device.

The pulp suspension is pumped through a tangential pulp inlet 17 into an injection chamber 54, set in rotation and accelerated up to a fluidized state with the aid of the wings 28 of the rotor 7 and at the same time fed onwards through a conical section 55 in the injection chamber 54, which section diverges in the direction of feeding, after which the fluidized pulp suspension flows into a turbulence chamber 9 which converges conically in the direction of feeding so that a cyclone effect is elicited. The vortex which has arisen in this way provides a locally powerful decrease in static pressure. The turbulence chamber 9 is closed at the tip of the conical surface, for which reason the pulp suspension, while moving in a turbulent manner, is forced to change direction and flow into the hollow shaft 52 of the rotor 7. At the same time, the fluid is supplied at the centre of the vortex, where the pressure is lowest, via the central fluid inlet 23. In this case, the speed of rotation of the vortex is a function of the speed of the rotor, the geometry and the flux which is flowing through. Experiments which have been carried out have shown that the speed of rotation can be in the order of size of 10,000 rpm and give a local drop in pressure of 5–6 bar below the prevailing reaction pressure. The fluid and the pulp mixture then pass out through oblong holes 33 in the hollow shaft 52 of the rotor 7 to a mixing chamber 57 where there is an impeller 58. The internal circulations in the mixing chamber S7 create a good mixing effect while, at the same time, the high reaction pressure can be retained. In those instances where the process requires additional agitation during the reaction time, the device described can, for example, be connected to some form of static mixer, by means of which the drop in pressure can be utilized in the form of a mixing effect. The finished fluid/pulp mixture is finally fed out through a tangential pulp outlet 20. By means of a central spreading body 24 situated at the orifice of the fluid inlet 23, the fluid, which is flowing in axially, is also provided with a radial movement component, resulting in favourable mixing into the vortex of fluidized pulp suspension. The spreading body 24 can also be made to be axially displaceable, it then being possible to vary the gap area which is formed between the conical surface of the spreading body 24 and the circular orifice of the fluid inlet 23 with a view to regulating the flow of fluid into the turbulence chamber 9.

Figure 5:
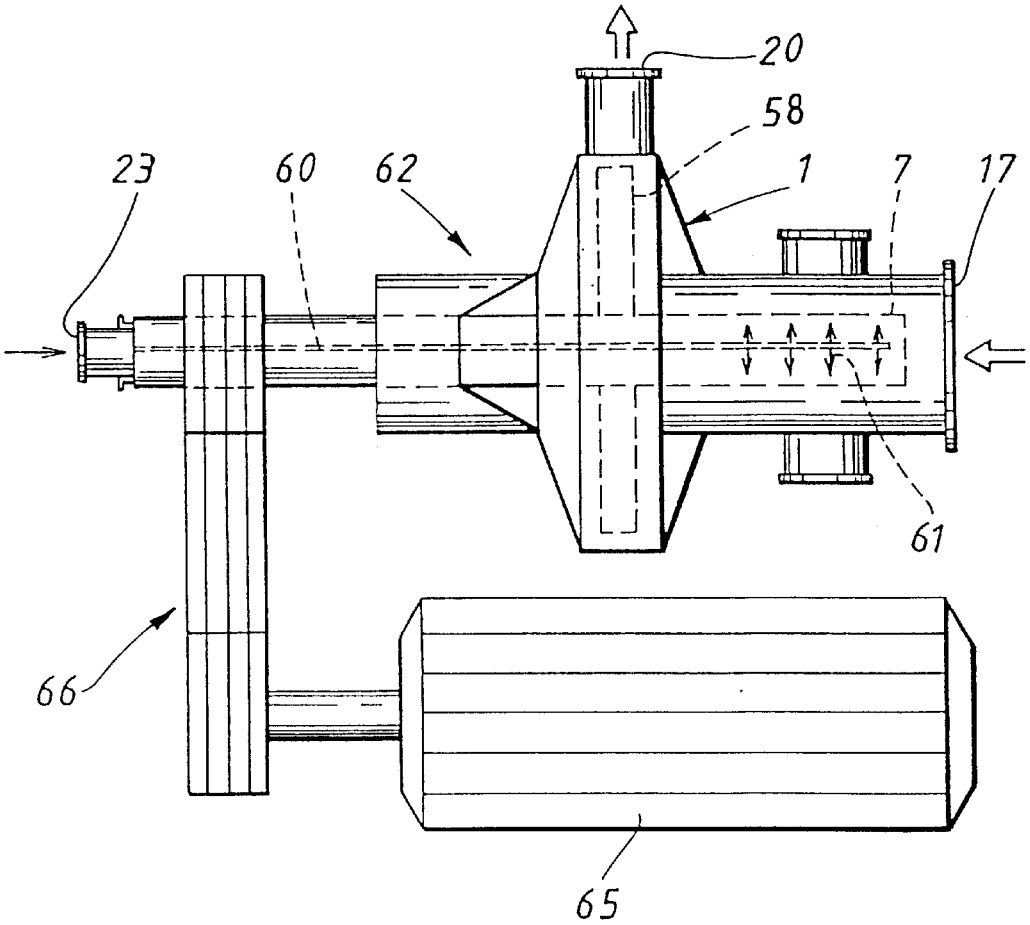
FIG. 5 shows a third embodiment of the invention.

FIG. 5 shows a third embodiment of the invention in which an existing mixer equipment is used, the fluid being added through a hollow shaft, modified for the invention, in this equipment. In this case, the existing mixer 62 has an axial pulp inlet 17 on the right of the figure and a tangential pulp outlet 20. The mixer 62 is equipped with a rotor 7, here in the form of a shaft shown diagrammatically by dashes, and an impeller 58 which is fixed into the rotor 7. In analogy with the preceding embodiments, the rotor 7 and the impeller 58 can be said to be enclosed in a stator shell 1. With the aim of being able to apply the invention by modifying the existing mixer 62, the shaft of the rotor 7 is made thicker and hollow so that a channel 60 runs centrally through the rotor 7, where the channel 60 opens out through the straight part of the rotor via bored holes 61 of relatively large diameter in order not to be blocked up by the pulp suspension. However, the risk of the holes 61 of the channel 60 being blocked is slight since the rotation of the pulp suspension throws the pulp away from the orifices of the holes 61. In the embodiment shown, the rotor 7 is driven by an electrical motor 65 via a V-belt gear 66, which makes it possible to place the fluid inlet 23 at the end of the shaft of the rotor 7, as is evident from the figure.

Figure 6:
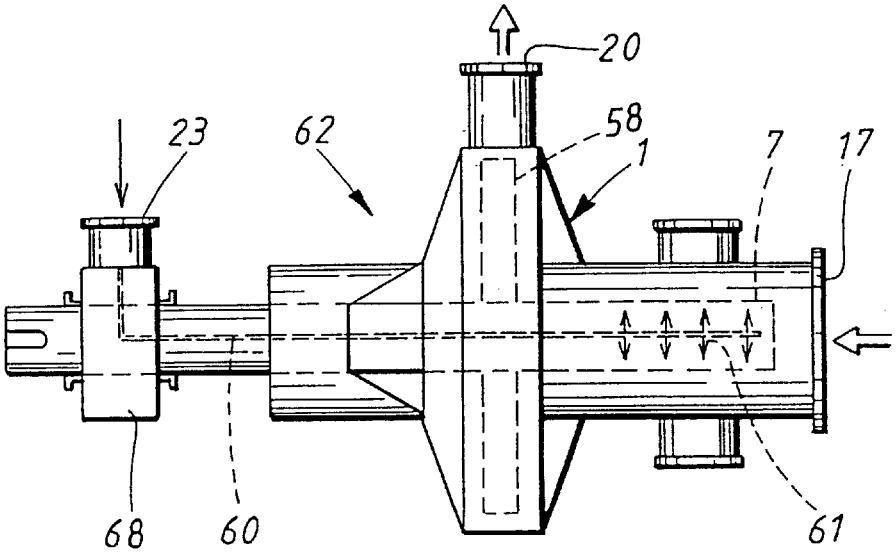
FIG. 6 shows a fourth embodiment of the invention.

FIG. 6 shows an existing mixer 62, identical to that shown in FIG. 5, in which the fluid inlet 23 is tangentially connected to the channel 60 via a mechanically sealed charging box 68. This embodiment is very suitable when the shaft of the rotor 7 is driven directly by an external electrical motor (not shown).

Figure 7:
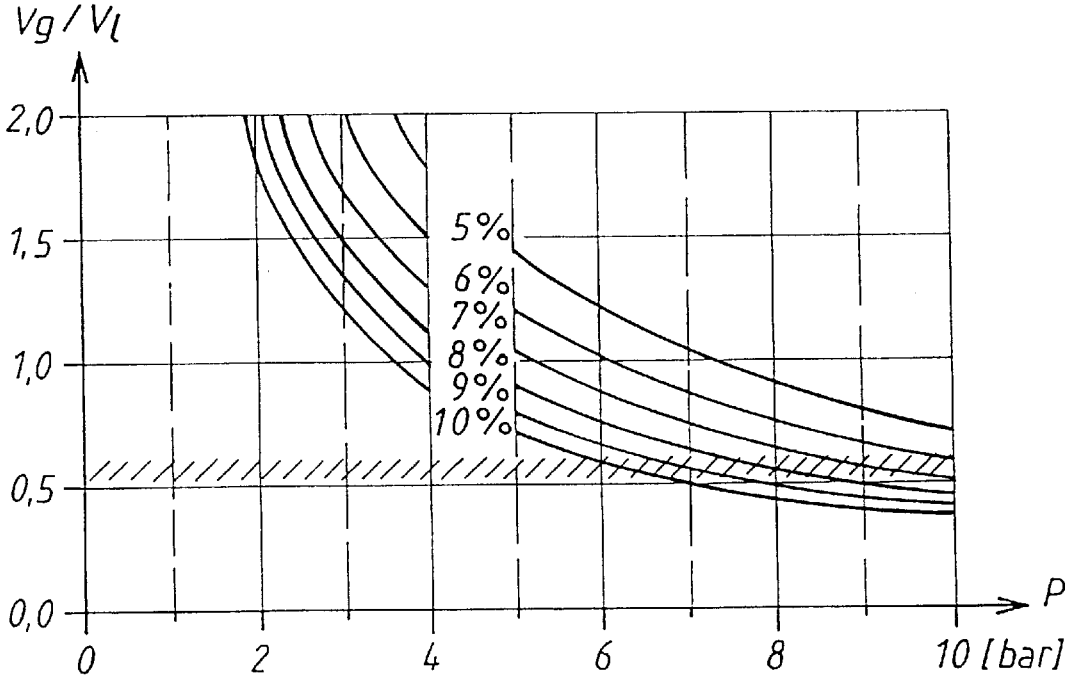
FIG. 7 shows a graph of the so-called gas/liquid quotient $V_g/V_l$ as a function of the charging pressure p.

In an instance of practical application, it was found that use of an embodiment according to FIG. 5 or 6 makes it possible to raise the reaction pressure by about 2 bar, from about 7–8 bar to 9–10 bar. This might seem to be a marginal gain, but its importance is clearly evident from FIG. 7 which shows a graph of the so-called liquid/gas quotient $V_g/V_l$ ($m^3$/gas/$m^3$/liquid) as a function of the charging pressure p, at an ozone charge of 4 kg $O_3$/ADMT and different ozone concentrations (5–10%). In the graph, it is evident that the gas/liquid quotient $V_g/V_l$ levels out in just this elevated pressure range (9–10 bar), with a nearly optimal admixing effect being achieved in this pressure range, where further pressure elevation would not noticeably improve the result.

Figure 8:
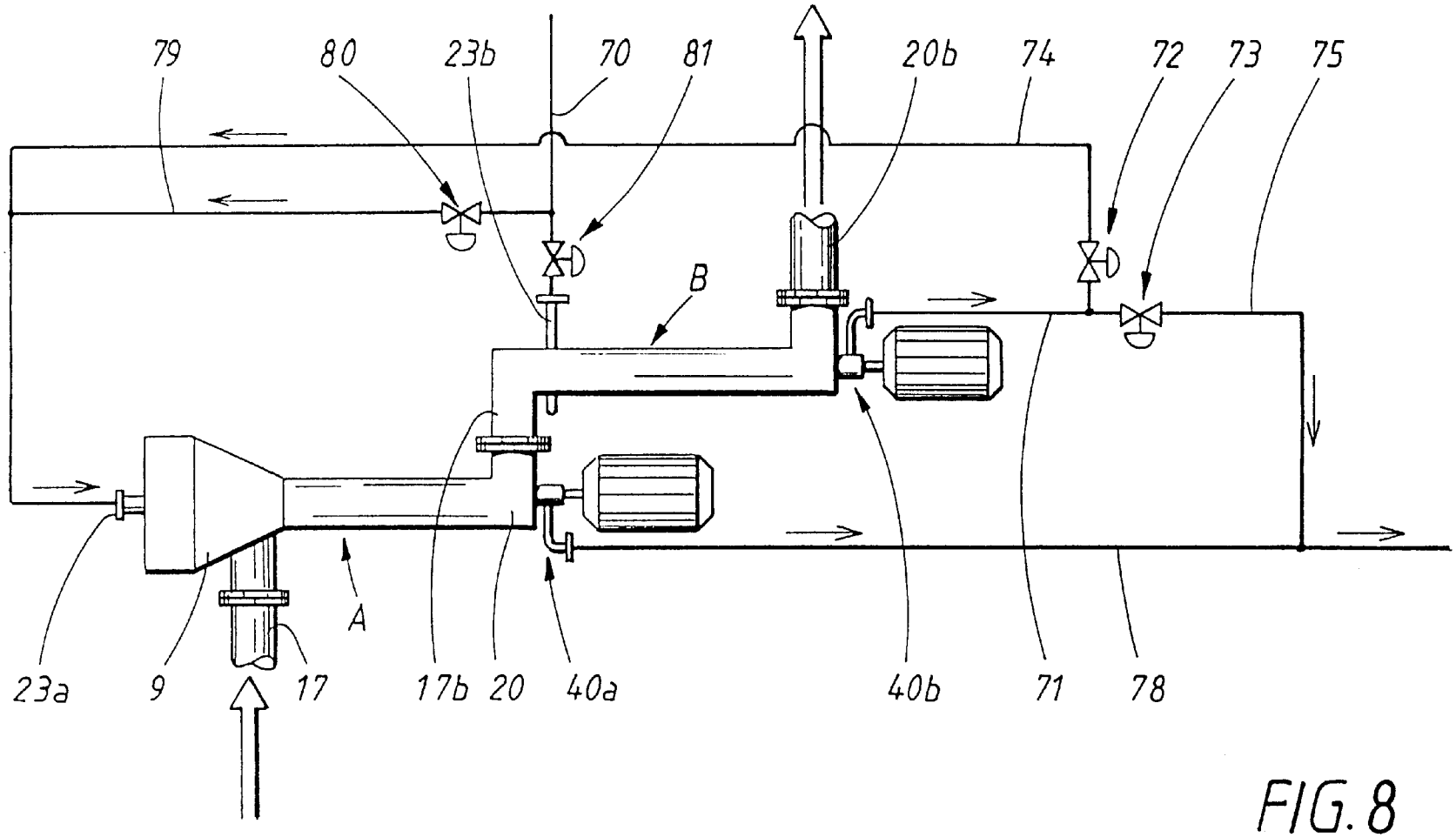
FIG. 8 shows an application of the invention in which two ozone-mixing devices have been coupled in series thereby rendering it possible to recirculate ozone gas.

Finally, FIG. 8 shows a particularly advantageous application of the invention in which the pulp suspension is fed tangentially, via a pulp inlet 70, into a first mixer A provided with turbulence chamber 9 in accordance with the first embodiment described in FIG. 1. The pulp suspension is then fed out through the tangential pulp outlet 20 in order, thereupon, to be fed into the tangential inlet 17*b* to a second mixer B, after which the pulp suspension is fed out through the tangential outlet 20*b* of the second mixer. In this case, both the mixer A and the mixer B are provided with gas separators 40*a* and 40*b*, respectively, in connection with their pulp outlets 20*a* and 20*b*, respectively. The gas flow in the device runs in the following manner: highly concentrated ozone gas is added to the tangential gas inlet 23*b* of the mixer B via the incoming conduit 70. After passing through the mixer, the pulp suspension is degassed in the gas separator 40*b*. The separated gas is fed out through a conduit 71 and is guided, by manipulating the valves 72 and 73, either into the conduit 74, which leads to the central gas inlet 23*a* in mixer A, or further onwards via the conduit 75 to an external scrubber unit which is not shown. In the case of the first alternative, the gas is thus fed into the mixer A. This advantageous feeding in of separated gas is made possible by the low central pressure which prevails at the central gas inlet 23*a* of the mixer A in accordance with the invention. The gas which is then separated from the mixer A in the gas separator 40*a* is conducted out via the conduit 78 to the previously mentioned scrubber unit. The conduit 70 for adding highly concentrated ozone gas to mixer B is also connected to a branching conduit 79 which can be opened or closed by means of a regulating valve 80. When the valve 72 is closed and the valve 80 is opened, ozone gas can, with this arrangement, be fed directly from the conduit 70 via the conduit 79 and into the mixer A via the conduit 74, if so desired. Furthermore, the gas supply to the gas inlet 23*b* of the mixer B can be opened and closed by means of a regulating valve 81.

Due to the fact that the mixer A has a central gas inlet 23*a* in accordance with the invention, an opportunity is thus created for recirculating the gas from the mixer B, which is a mixer of more conventional type having a tangential gas inlet 23*b*, in which the system pressure is the same as the maximum reaction pressure even at the gas inlet. By means of coupling in series in this way, great flexibility is achieved in charging with fresh ozone gas and in recirculating inert gas and residual ozone gas. The gas/pulp ratio can also be regulated by these means.

The present invention is not limited to the embodiments described above and illustrated on the drawings, but can be varied at will within the scope of the subsequent patent claims.

What is claimed is:

1. A device for mixing fluid into a pulp suspension of cellulose-containing fibre material, comprising:

a pulp inlet for the pulp suspension;

a pulp outlet for fully treated pulp mixture; and a reaction section located in between the pulp inlet and the pulp outlet, the reaction section comprising a stator shell, a rotor coaxial with the stator shell, an annular gap defined between the rotor and the cylindrical shell, and at least one fluid inlet;

wherein said fluid is located in close proximity to a common central axis of the rotor and the stator shell in such a manner that the fluid is supplied substantially into the center of rotation of the rotating pulp suspension and the pulp and fluid thereafter passing in a radial direction by radially directed openings in the rotor to the annular gap, whereby an intensive mixing takes place in the annular channel, by projecting flow-effecting elements provided at the rotor, whereafter finished pulp mixture is fed out in a tangentially direction to the stator shell after having passed the annular channel.

2. A device for mixing fluid into a pulp suspension of cellulose-containing fibre material, comprising:

a pulp inlet for the pulp suspension;

a pulp outlet for fully treated pulp mixture; and a reaction section located in between the pulp inlet and the pulp outlet, the reaction section comprising a stator shell, a rotor coaxial with the stator shell, an annular gap defined between the rotor and the cylindrical shell, and at least one fluid inlet;

wherein said fluid inlet is located in close proximity to a common central axis of the rotor and the stator shell in such a manner that the fluid is supplied substantially into the center of rotation of the rotating pulp suspension and the pulp and fluid thereafter passing in a radial direction by radially directed opening in the rotor to the annular gap, whereby an intensive mixing takes place in the annular channel, by projecting floweffecting elements provided at the rotor, whereafter finished pulp mixture is forced out by centrifugal force in a tangentially direction to the stator shell by fluidising blades fixed upon the rotor after having passed the annular channel.

* * * * *